United States Patent [19]

Rand

[11] Patent Number: 4,521,900

[45] Date of Patent: Jun. 4, 1985

[54] ELECTRON BEAM CONTROL ASSEMBLY AND METHOD FOR A SCANNING ELECTRON BEAM COMPUTED TOMOGRAPHY SCANNER

[75] Inventor: Roy E. Rand, Palo Alto, Calif.

[73] Assignee: Imatron Associates, South San Francisco, Calif.

[21] Appl. No.: 434,252

[22] Filed: Oct. 14, 1982

[51] Int. Cl.[3] ..... H01J 35/00; H01J 35/04; H01J 35/24

[52] U.S. Cl. ..... 378/137; 378/10; 313/424; 250/396 R

[58] Field of Search ..... 378/137, 113, 10, 138; 313/424, 390; 250/396

[56] References Cited

U.S. PATENT DOCUMENTS

| | | | |
|---|---|---|---|
| 2,517,260 | 8/1950 | Van De Graaff | 250/396 |
| 2,921,212 | 3/1956 | Berthold | 313/424 |
| 3,512,038 | 5/1970 | Kazan | 313/390 |
| 3,622,741 | 11/1971 | Steigerwald | 250/396 |
| 3,644,778 | 2/1972 | Mihran | 315/5.38 |
| 4,352,021 | 9/1982 | Boyd | 378/137 |
| 4,427,917 | 1/1984 | Mizushima | 313/390 |

*Primary Examiner*—Alfred E. Smith
*Assistant Examiner*—Charles F. Wieland
*Attorney, Agent, or Firm*—Flehr, Hohbach, Test, Albritton & Herbert

[57] ABSTRACT

An electron beam production and control assembly especially suitable for use in producing X-rays in a computed tomography (CT) X-ray scanning system is disclosed herein along with its method of operation. This assembly produces its electron beam within a vacuum-sealed housing chamber which is evacuated of internal gases, except inevitably for small amounts of residual gas. The electron beam is produced by suitable means within the chamber and directed along a path therethrough from the chamber's rearwardmost end to its forwardmost end whereby to impinge on a suitable target for producing the necessary X-rays. Since there is residual gas within the chamber, the electrons of the beam will interact with it and thereby produce positive ions which have the effect of neutralizing the space charge of the electron beam. However, there are a number of different arrangements disclosed herein which form part of the overall assembly for acting on these ions and reducing the neutralizing effect they would otherwise have on the beam.

30 Claims, 17 Drawing Figures

STEPPED BEAM PIPE WITH BEAM AND ION CLEARING ELECTRODES

TRANSVERSE POTENTIAL DISTRIBUTIONS DUE TO BEAM AND I.C.E. AT POSITION OF FIRST I.C.E. (62)

ELECTRODES FOR GRADED POTENTIAL ION CLEARING

POTENTIAL AT BEAM AXIS

MAGNETIC ION CLEARING

ELECTRON BEAM CONTROL ASSEMBLY AND METHOD FOR A SCANNING ELECTRON BEAM COMPUTED TOMOGRAPHY SCANNER

The present invention relates generally to the production and control of an electron beam which is especially suitable for use in producing X-rays in a computed tomographic X-ray transmission scanning system, and more particularly to a number of different techniques for preventing the electron beam from being neutralized to any appreciable extent due to the presence of positive ions.

There are presently a number of different types of X-ray transmission scanning systems described in the prior art including one which is disclosed in U.S. patent application Ser. No. 109,877 (Boyd et al) filed Jan. 7, 1980 now U.S. Pat. No. 4,352,021 system, an electron beam is produced within an evacuated housing chamber and directed along a first straight line path and thereafter caused to bend into a scanning path where it eventually impinges a suitable target for producing X-rays. During this procedure, if there is any residual gas present within the beam chamber as is inevitable, the electron beam will interact with it and thereby produce positive ions. Applicant has found that this effect should not be ignored since the presence of positive ions has the effect of neutralizing the space charge of the electron beam. Beam neutralization, in turn, adversely affects the focusing the optical stability characteristics of the beam which are necessary if the beam is to function in the intended manner.

As described in the Boyd et al patent application recited above, the electron beam disclosed there is first caused to expand from its originating point (a suitable electron gun) to the point at which it is scanned, where are situated suitable focusing and deflecting coils. From this latter point the beam is scanned along an X-ray target and, at the same time, focused onto the latter to form a spot thereon. The size of this beam spot should be as small as possible. However, since its size depends (inversely) on the size of the beam at the focus and deflecting coils, the size of the beam (its cross-section) at these latter components should be as large as possible. In addition, the configuration of the beam spot on the target (its shape and orientation) should be accurately and reliably controlled. If the electron beam is neutralized to any appreciable degree between the electron gun and coils it will tend not to expand thereby reducing its size at the focus and bending coils. Furthermore, neutralization if uncontrolled will adversely affect the stability and therefore control of the beam. Thus, applicant has found it desirable to remove all of the positive ions within the beam chamber as rapidly as possible from specific collecting points or, at least, substantially reduce the neutralizing effect they have on the beam by causing them to act in certain ways, specifically by causing them to accelerate along the direction of the electron beam.

In view of the foregoing, one object of the present invention is to provide a technique for producing and controlling an electrion beam especially suitable for use in producing X-rays in a computed tomography X-ray scanning system and specifically a technique which acts on positive ions, which are typically present, for reducing the neutralizing effect they would otherwise have on the beam.

Another object of the present invention is to provide the last mentioned technique in an uncomplicated and yet reliable way.

A more specific object of the present invention is to reduce and preferably entirely eliminate electron beam neutralization by removing from the electron beam the positive ions which are produced by it during interaction with residual gases.

Another specific object of the present invention is to reduce electron beam neutralization by causing the positive ions produced by the beam to flow with or against the latter whereby to substantially reduce the neutralizing effect they have on the beam.

Still another specific object of the present invention is to eventually divert any positive ions flowing with the electron beam from the path of the latter and specifically by utilizing means which have been provided (and are needed) for another purpose, specifically a magnetic beam deflecting coil.

As will be described in more detail hereinafter, the electron beam production and control assembly disclosed herein is one which is especially suitable for use in producing X-rays in a computed tomography X-ray scanning system. This assembly includes a housing defining an elongated, vacuum-sealed chamber having opposite forward and rearward ends and means for evacuating the chamber of any gases therein. Inevitably, some residual gas remains in the chamber. The assembly also includes means for producing an electron beam within the chamber and for directing the beam along a path therethrough from its rearward end to its forward end, whereby to impinge on a suitable X-ray target located at the forward end. The electrons in the electron beam, interact with the residual gas just mentioned, and produce positive ions which, as stated previously, have the effect of neutralizing the space charge of the electron beam. However, in accordance with the present invention, means are provided for either removing these ions or acting on these ions in a way which reduces the neutralizing effect they would otherwise have on the beam.

In an actual working embodiment of the present invention, the electron beam forms negative potential wells at various regions along its length. These wells become traps for the positive ions as they are produced which, in turn, results in beam neutralization. In accordance with one embodiment of the present invention, the trapped ions are entirely removed from the chamber and from the beam itself by means of cooperating ion clearing electrodes located close to the potential wells.

In accordance with several other embodiments, the potential wells are reduced in size or preferably entirely eliminated and the ions are caused to flow with the beam (as if in a downwardly inclined trough) and thereby minimize their neutralization effect. One way in which this is accomplished is by utilizing specifically configurated graded potential electrodes. Another way to accomplish this is to design the inner housing surface surrounding the beam in a specific way. Both of these latter techniques relate specifically to the expanding section of the electron beam, that is, the section between its starting point (the electron gun) and its associated focus and deflecting coils. Using either of these approaches, ions are caused to flow with the electron beam to the coils and, in accordance with still another embodiment of the present invention, the deflecting coil serves not only to bend the electron beam in one direction but also directs the ions in an opposite direction, thereby removing the ions from the electron beam path.

The various embodiments just described briefly will be discussed in more detail hereinafter in conjunction with the drawings wherein.

Figure 1:
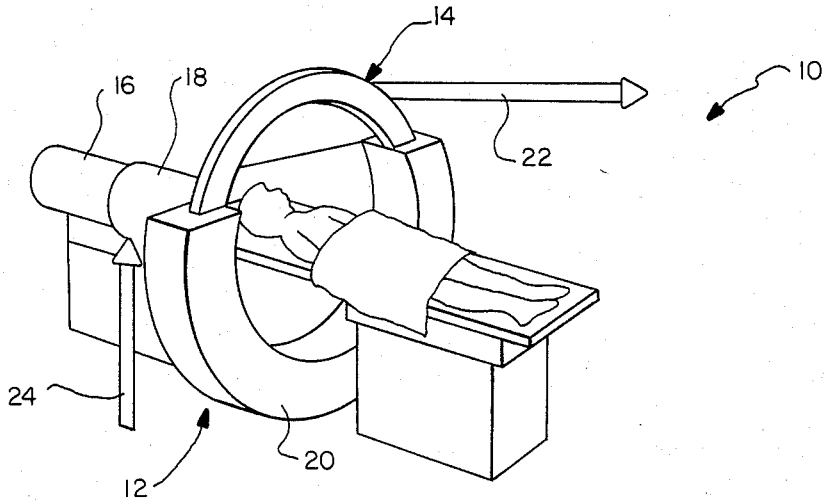
FIG. 1 is a schematic diagram partly in perspective view showing a computed tomography X-ray transmission scanning system which utilizes an assembly for producing and controlling an electron beam within an evacuated beam chamber in accordance with the present invention.
Figures 3, 4:
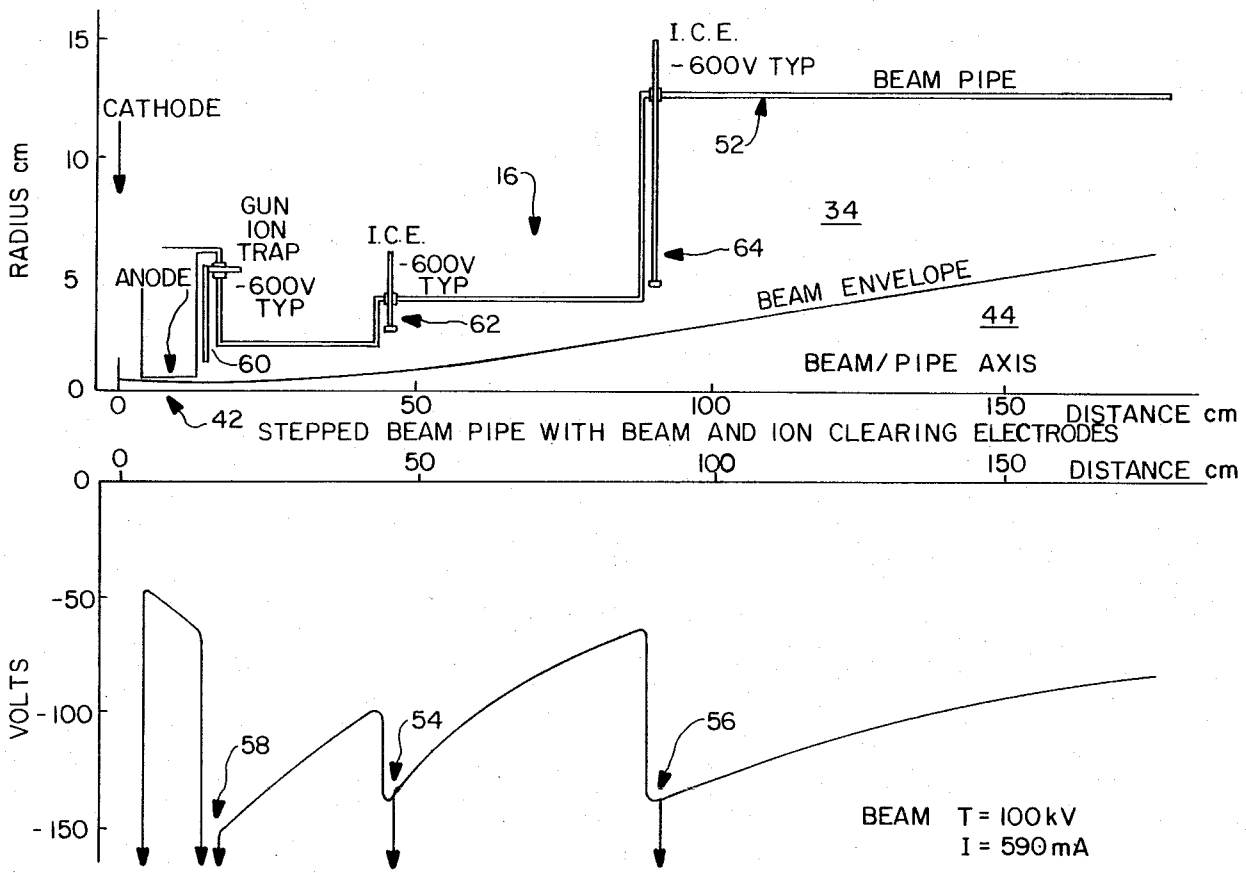
Figure 5:
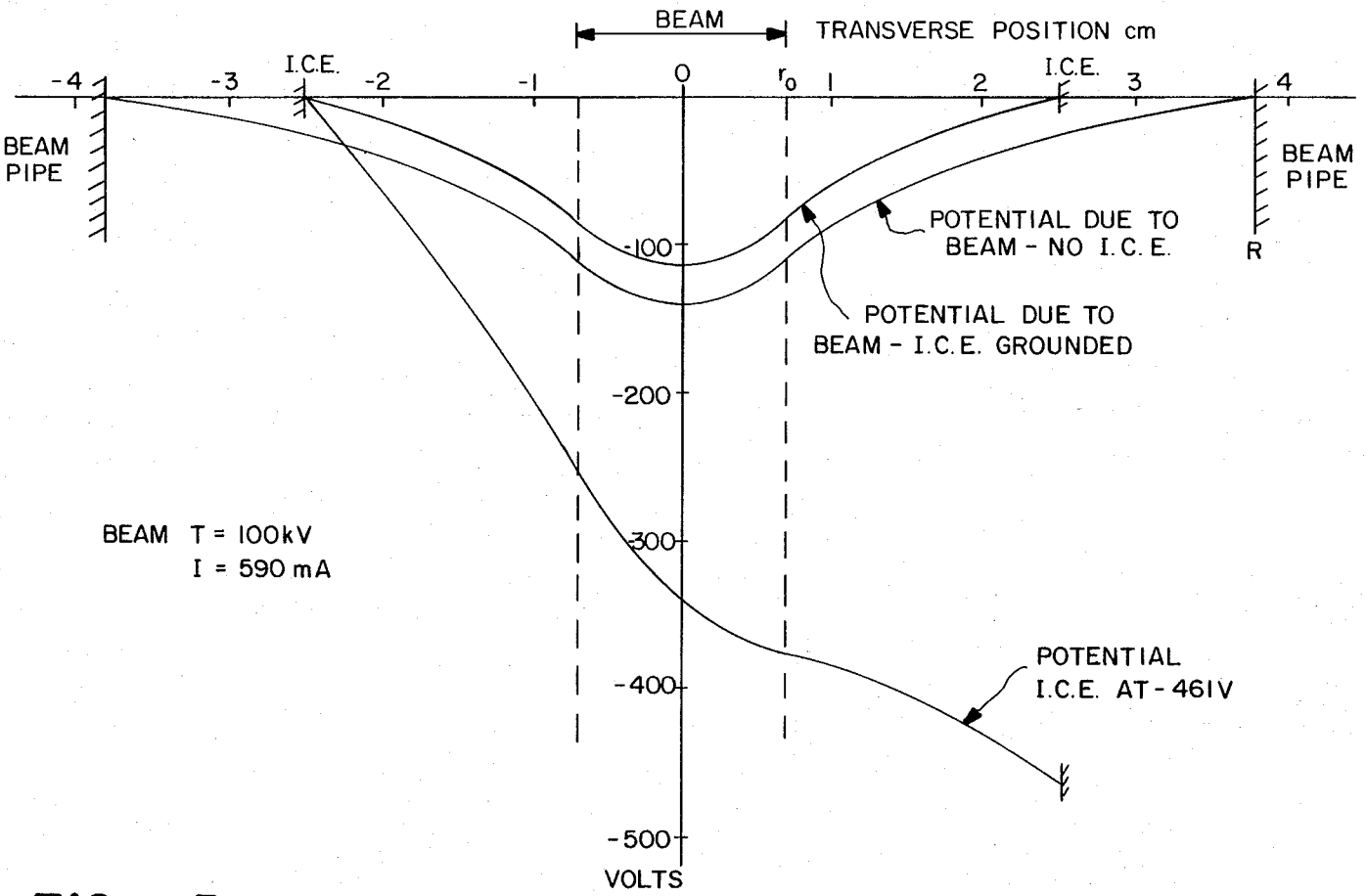
Figure 6:
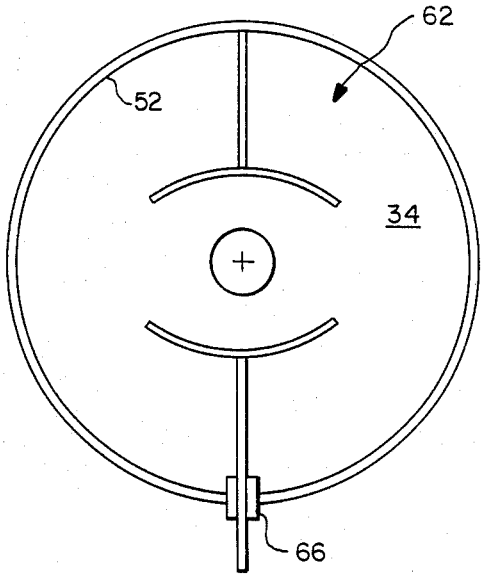
Figure 7:
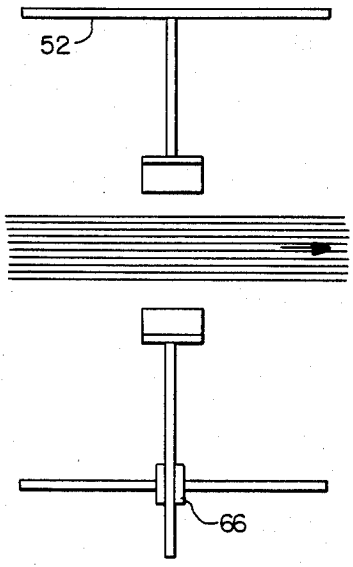
Figure 12:
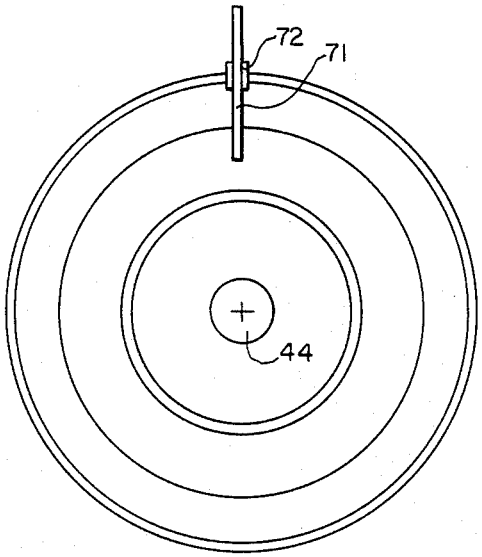
Figure 13:
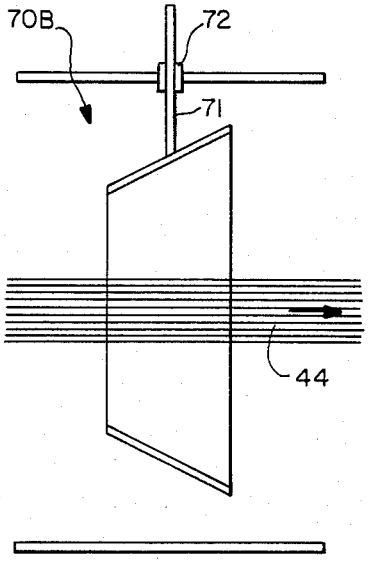
Figure 8:
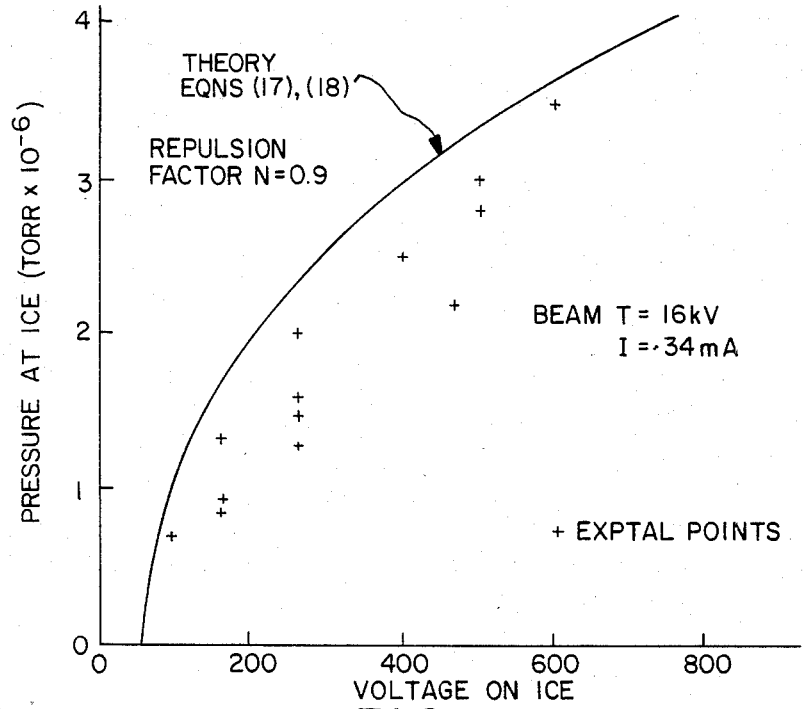
Figure 9:
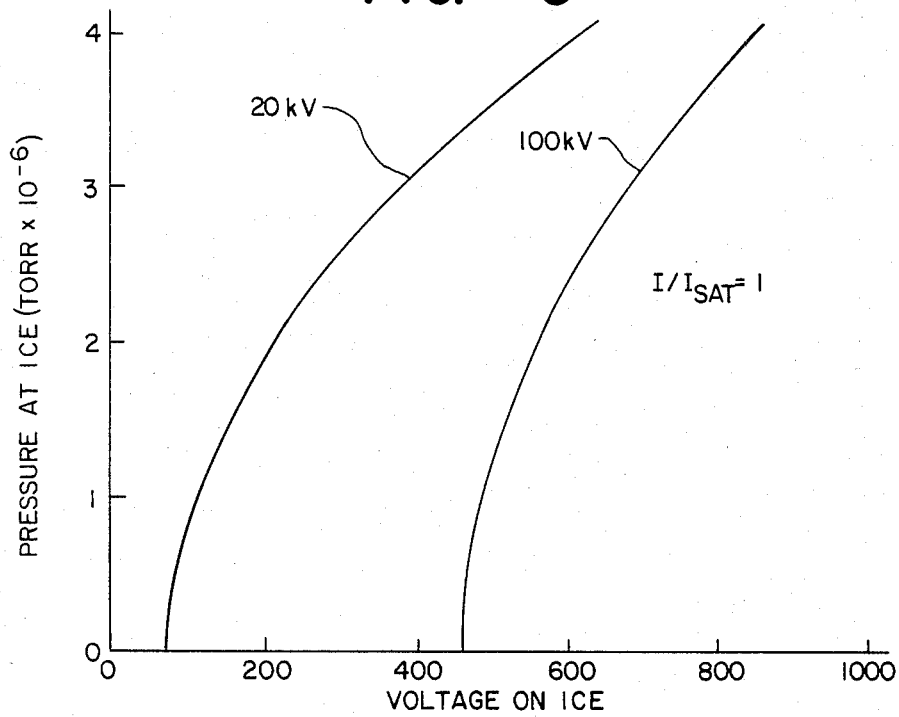
Figure 10:
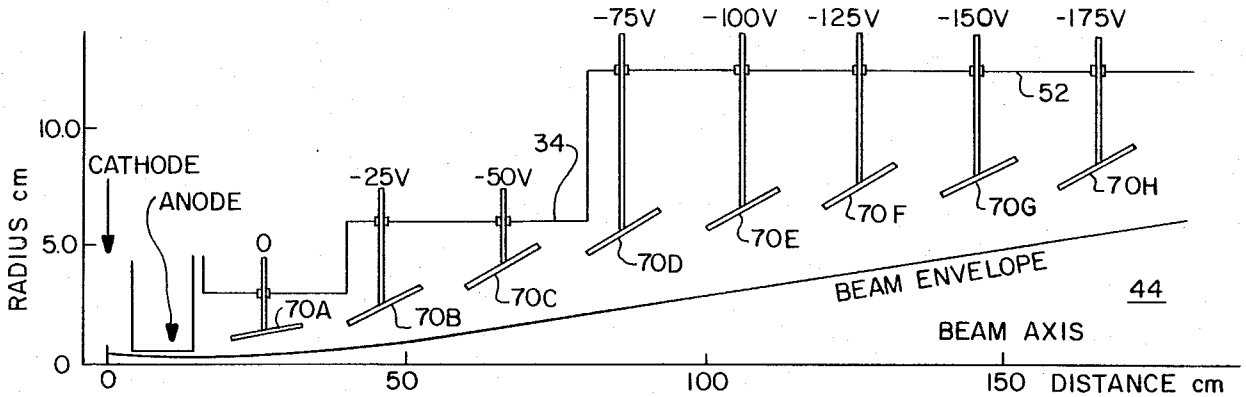
Figure 11:
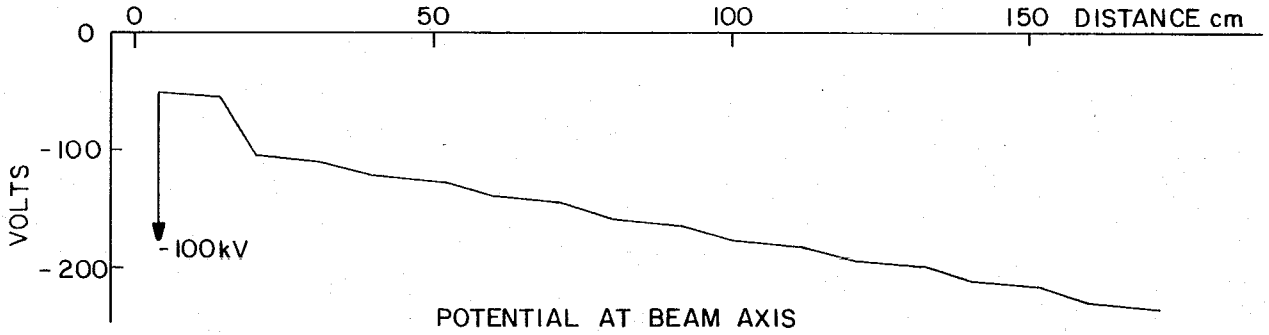
Figure 14:
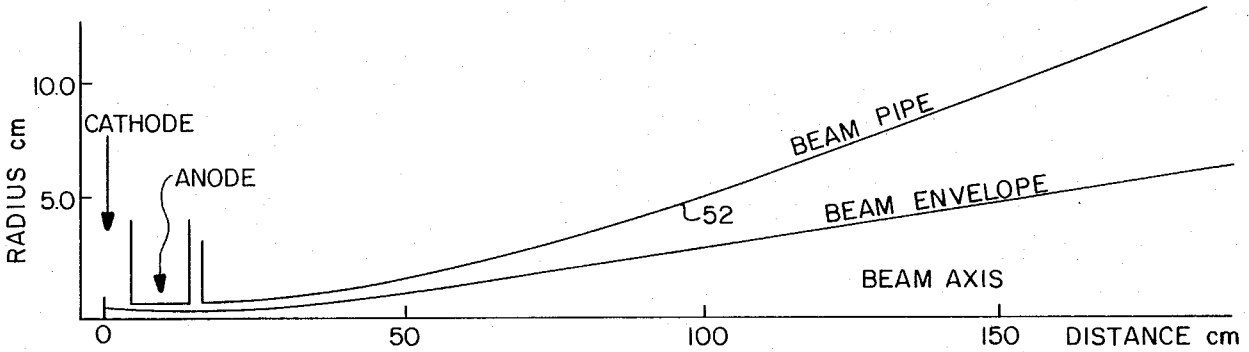
Figure 15:
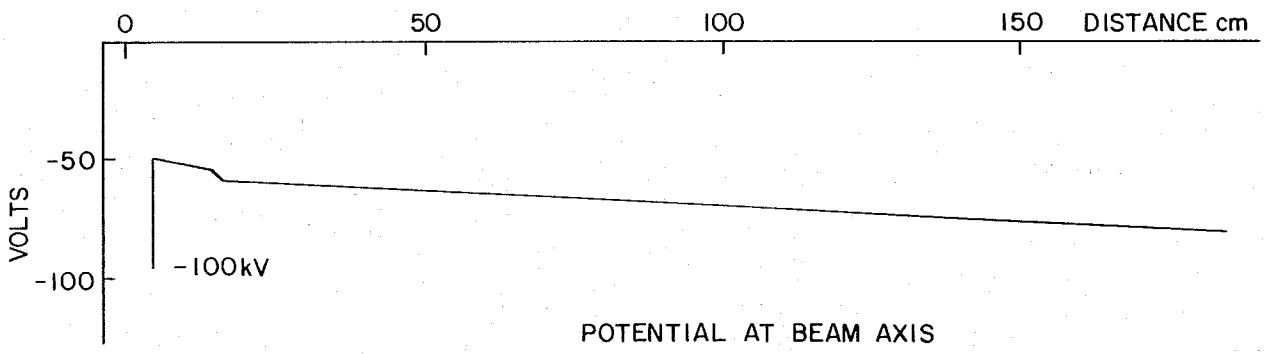
Figure 16:
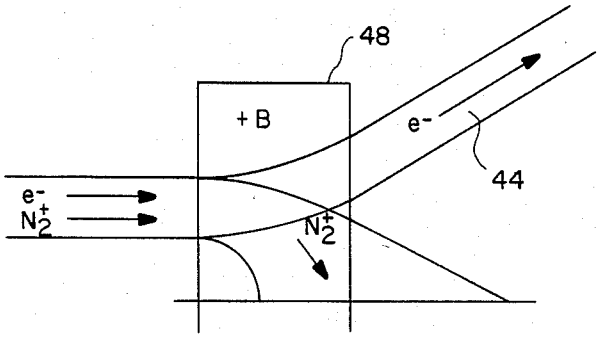
Figure 17:
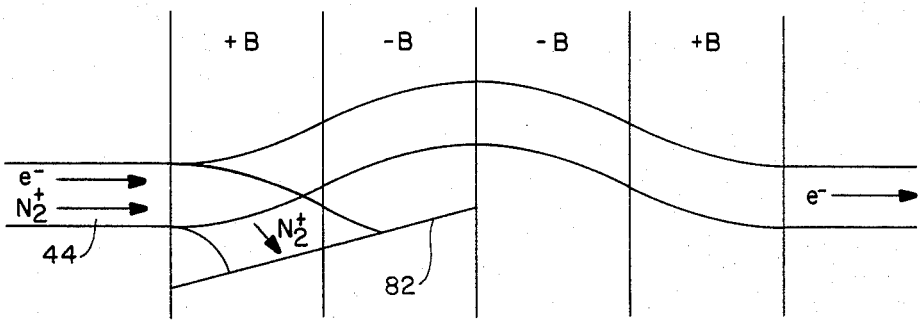

FIG. 3 diagrammatically illustrates the rearward section of a beam chamber forming one embodiment of the assembly illustrated in FIG. 1 and it specifically shows how the beam itself expands outward as it travels along the length of the chamber section shown;

FIG. 4 diagrammatically illustrates the potential along the axis of the beam section illustrated in FIG. 3;

FIG. 5 diagrammatically illustrates the transverse (radial) potential distribution of a pure cylindrical electron beam in a cylindrical beam pipe and the transverse potential distribution with a negative potential electrode at one side of the beam pipe;

FIG. 6 is a cross-sectional view of the beam housing illustrated in FIG. 3 and specifically through a particular ion clearing electrode forming part of the embodiment illustrated there;

FIG. 7 is a longitudinal sectional view of a portion of the beam housing through the ion clearing electrode illustrated in FIG. 6;

FIG. 8 shows theoretical and experimental values of the minimum voltage which must be applied to the ion clearing electrodes in the preferred embodiment, voltages being plotted against residual gas pressure for a beam of kinetic energy 16 kV;

FIG. 9 shows the same theory as FIG. 8 for kinetic energies 20 kV and 100 kV;

FIG. 10 diagrammatically illustrates the rearward section of an electron beam production and control assembly designed in accordance with a second embodiment of the present invention and specifically shows a series of graded potential electrodes forming part of the assembly;

FIG. 11 graphically illustrates the potential along the axis of the electron beam associated with the assembly section illustrated in FIG. 10;

FIG. 12 is a cross-sectional view of the housing section illustrated in FIG. 10 taken specifically through one of its graded potential electrodes;

FIG. 13 is a longitudinal sectional view of the housing section illustrated in FIG. 10 through the electrode illustrated in FIG. 12;

FIG. 14 diagrammatically illustrates the rearward end section of an electron beam production and control assembly designed in accordance with a third embodiment of the present invention;

FIG. 15 is graphically illustrates the potential along the axis of the electron beam through the housing section illustrated in FIG. 14;

FIG. 16 diagrammatically illustrates an arrangement for deflecting positive ions out of the path of an electron beam especially suitable for use with the electron beam production and control assembly embodiments illustrated in FIGS. 10 and 14;

FIG. 17 diagrammatically illustrates a modification to the arrangement illustrated in FIG. 16

Turning now to the drawings, wherein like components are designated by like reference numerals throughout the various figures, attention is first directed to FIG. 1 which illustrates an overall computed tomography X-ray transmission scanning system generally indicated by the reference numeral 10. This system is shown including two major components, an electron beam production and control assembly 12 designed in accordance with the present invention and a detector array 14. The system also includes a third major component which is not shown, specifically a data acquisition and computer processing arrangement.

Assembly 12 includes a rearwardmost end section 16 for producing an expanding electron beam along a straight line path toward an intermediate section 18 also forming part of the assembly. Intermediate section 18 serves to bend the electron beam through a forward section 20 of the assembly in a scanning manner and to focus it onto a cooperating arrangement of targets for the purpose of generating X-rays. These X-rays are intercepted by the detector array 14 for producing resultant output data which is applied to the computer processing arrangement as indicated by the arrow 22 for processing and recording the data. The computer arrangement also includes means for controlling the electron beam production and control assembly as indicated by arrow 24.

Figure 2:
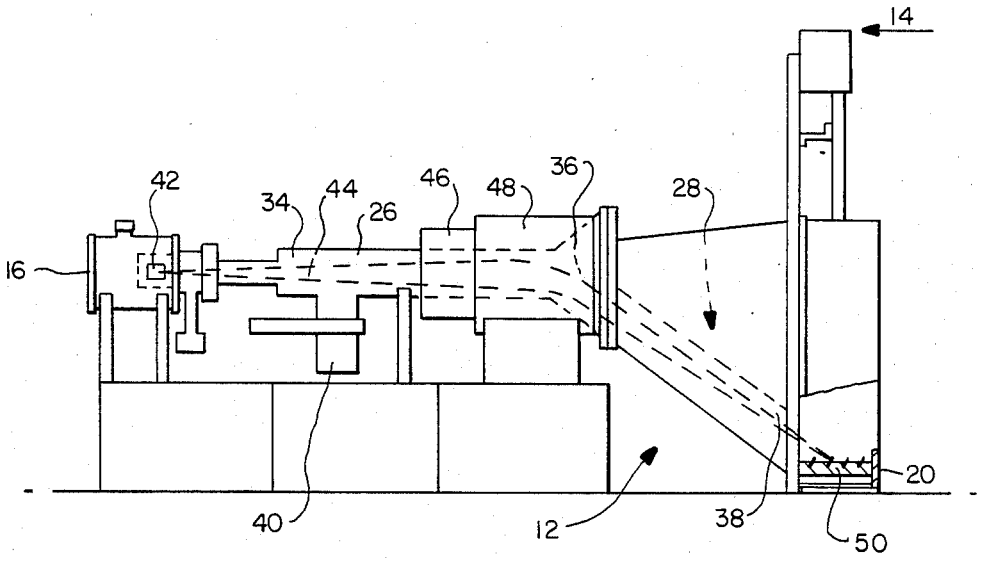
FIG. 2 is a cross-sectional view of the system shown in FIG. 1.

Referring specifically to FIG. 2, overall assembly 12 is shown including a housing 26 which defines an elongated, vacuum-sealed chamber 28 having previously recited rearward end 16 and forward end 20. This chamber may be divided into three sections, a rearwardmost chamber section 34, an intermediate section 36 and a forwardmost section 38. The overall chamber is evacuated by any suitable means generally indicated at 40, except for inevitable small amounts of residual gas. An electron gun 42 is contained within chamber section 34 at its rearward end 16 for producing a continuously expanding electron beam 44 and for directing the latter towards intermediate section 36 through chamber section 34 in co-axial relationship with the latter. Chamber section 36 includes focusing coils 46 and deflecting coils 48 which bend the incoming beam into chamber section 38 for impingement on X-ray target 50 while, at the same time, focusing the beam on the target which is located at forward end 20 of chamber section 38.

As stated above, overall chamber 28 is evacuated of internal gases as much as possible. Small amounts of residual gas which are typically nitrogen, oxygen, water, hydrocarbons and metal vapors inevitably remain. Since residual gas is typically present within the chamber, the electron beam will interact with it to produce positive ions which have the effect of neutralizing the space charge of the electron beam. This causes the beam to become unstable and the magnetic field generated by the beam itself can ultimately cause the latter to collapse. As will be seen hereinafter, the present invention is specifically directed to different techniques for acting on these ions, in a way which reduces the neutralizing effect they would otherwise have on the beam in order to stabilize the latter and prevent it from collapsing. Except for the various ways in which this is accomplished, the overall electron beam production and control assembly 12 and the scanning system in general may be identical to the one described in the previously recited Boyd et al patent which is incorporated herein by reference.

Before turning specifically to the various ways in which the above-mentioned positive ions are acted upon in accordance with the present invention for reducing and preferably entirely eliminating electron beam neutralization and in order to more fully appreciate how this is done, it is important to understand some of the theory (physics) involved. More specifically, it is important to have a better understanding (1) of the behavior of a partially neutralized electron beam, (2) of the production of ions within the assembly chamber, (3) of the characteristic time involved in charge neutralization, (4) of the kinematics of the ion production process, (5) of the formation of potential wells by the beam and their effect on any ions which might be present, and (6) of the inherent limitations associated with beam neutralization and ion removal.

For a cylindrically symmetric charge limited electron beam with uniform current density, the equation of motion of the beam envelope radius r is:

$$\frac{d^2r}{dz^2} = \frac{SIN}{2I_{SAT}r} + \frac{\epsilon^2}{r^3} \quad (1)$$

where z is in the direction of motion, $\epsilon$ is the beam emittance,

I is the beam current, $I_{SAT}=K[T(1+T/2m)]^{3/2}$ is the saturated current of the gun, where K is the gun perveance, m is the mass of the electron, and T is the kinetic energy of the beam. (T and all masses are expressed in volts), $S=\sqrt{2m\eta_0 K}$, *where*

$\eta_0=30\Omega$ is the resistance of free space, and $$N = \frac{1-f-\beta^2}{1-\beta^2}$$

is the repulsion factor, where f is the neutralization fraction due to positive ions in the beam, and $\beta$ is the velocity of the electrons divided by the velocity of light.

In general, f and N are functions of z.

For present purposes of the discussion is restricted to the case where $\epsilon$ is very small, $I=I_{SAT}$ and f and N are independent of z. Then:

$$d^2r/dz^2=SN/2r \quad (2)$$

and $$dr/dz=[SN \ln \Delta]^{\frac{1}{2}} \quad (3)$$

where $\Delta=r/r_{min}$ and $r_{min}$ is the radius of the beam at a waist. The solution of equation (3) is:

$$\int \sqrt{N}\, dz = \frac{r\,\min}{\sqrt{S}} \int_1^{\Delta} \frac{da}{\sqrt{\ln a}} = \frac{2r_{min}}{\sqrt{S}} \int_0^{\ln \Delta} e^{t^2}\, dt \quad (4)$$

in most cases f, N are functions of the residual gas pressure which tends to fluctuate, mostly because of target outgassing. Thus in order to provide a stable beam, either the pressure must be carefully controlled or it must be ensured that $f<<1$, i.e., $N\simeq 1$. (If $N-0$ and $f>(1-\beta^2)$, the beam becomes self-focusing, i.e., the forces on the electrons become attractive.)

As stated previously, positive ions are produced by the beam electrons interacting with the residual gas which is now assumed to be nitrogen. The production rate may be calculated assuming that the gas consists of single atoms whereas most of the ions formed are probably $N_2+$.

Referring to *The Quantum Theory of Radiation,* W. Heitler, Oxford Univ. Press, London, 3rd Ed. 1954, the production cross-section is:

$$\sigma = \frac{4\pi r_0^2 Zm}{E_p\beta^2}\left[\ln \frac{T}{E_I Z\sqrt{2}} + \frac{1}{2}\right] \quad (5)$$

where $r_0$ is the classical electron radius

Z is the effective atomic number of the residual gas, $E_p=32$ V and $E_I=12$ V.

As an example: $\sigma=2.68\times10^{-18}$ cm$^2$ at T=100 kV and $\sigma=8.49\times10^{-18}$ cm$^2$ at T=20 kV. The number of atoms per unit volume is:

$$N_A=N_0\rho/A$$

where $N_0$ is Avogardro's number, $\mu$ is the residual gas density and A its effective atomic mass.

For example: $N_A=7.3\times10^9$ cm$^{-3}$ at pressure$=10^{-7}$ Torr.

The number of ions produced by the beam is:

$$\frac{I}{e}\,\sigma\, N_A \text{ cm}^{-1}\text{ sec}^{-1}$$

where e is the electronic charge

The number of electrons in 1 cm of beam is $N_e=I/e\beta c$, where c is the velocity of light.

Hence if no ions escape from the beam, the characteristic time for charge neutralization is:

$$t_n=1/(\beta c\sigma N_A) \quad (6)$$

For example:

$t_n=3.1$ msec at 100 kV, $10^{-7}$ Torr $t_n=2.0$ msec at 20 kV, $10^{-7}$ Torr Thus, ionization cannot be ignored when the typical scan time is approximately 50 msec.

Molecular ions can acquire momenta in the direction of the beam ranging from 0 to approximately $2\sqrt{2}$mT. Assuming isotropic scattering, the mean velocity acquired by the ions in the beam direction is:

$$v_0 \simeq c\sqrt{2mT}/M \quad (7)$$

where M is the mass of the ion ($N_2+$). For example:

$v_0\simeq3.68\times10^5$ cm/sec at T=100 kV and $v_0\simeq1.65\times10^5$ cm/sec at T=20 kV.

Hence, the mean kinetic energy of the ions is:

$$T_I\simeq Mv_0^2/c^2 \quad (8)$$

For example $T_I \simeq 3.92$ V at T=100 kV and $T_I \simeq 0.79$ V at T=20 kV.

As will be shown, the beam forms negative potential wells which trap the positive ions. The depth of any such well at the center of the beam is calculated as follows: The transverse electric field inside the beam is $$E = -E_0 r/r_0 \tag{9}$$

where $E_0 = 2\eta_0 I/\beta r_0$ and $r_0$ and $r_0$ is the radius of the beam envelope. The electric field outside the beam is $$E = -E_0 r_0/r \tag{10}$$

Thus, assuming that the potential is zero at the beam tube housing, radius R, the potential at the center of the beam is:

$$U_0 = -\frac{1}{2} E_0 r_0 (1 + 2 \ln R/r_0) \tag{11}$$

$$= -\frac{\eta_0 I}{\beta} (1 + 2 \ln R/r_0)$$

For example $\eta_0 I/\beta = 32.3$ V at 100 kV, I=0.590A and $\eta_0 I/\beta = 5.2$ V at 20 kV, I=0.047A Note that $|U_0| >> T_I$ so it can be assumed that the ions are formed at rest and it is unlikely that they will escape from the beam. Instead, they will be trapped and oscillate inside the potential well.

For a stepped beam tube such as shown in FIG. 3, equation (11) predicts an axial potential distribution which contains minima or potential wells as shown in FIG. 4. Positive ions formed anywhere along the beam will drift towards one of these potential wells, which represent therefor the best place to remove them from the beam.

Ions must not be allowed to accumulate in these wells or anywhere in the vicinity of a waist in the beam where it is important that the electron space charge not be neutralized. Suppose some method is available for removing the ions as they accumulate in one of these regions. Then the equilibrium value of the neutralization fraction may in general be calculated as follows:

Suppose the length of the region from which the ions may be extracted is l and that the length of beam from which ions are attracted to the region is L. Then the rate at which ions enter the region is the rate at which they are produced in the length L: $\sigma N_A LI/e$. If the instantaneous number of ions in the length l is $N_I$, then the rate at which ions are removed from the region is $N_I \bar{t}$, where $\bar{t}$ is the average time required to remove an ion. Thus, the equation determining $N_I$ is:

$$\frac{dN_I}{dt} = \frac{I}{e} \sigma N_A L - \frac{N_I}{\bar{t}} \tag{12}$$

or in terms of the neutralization factor, f $$\frac{df}{dt} = \frac{\sigma N_A L \beta c}{l} - \frac{f}{\bar{t}} \tag{13}$$

This is compatible with equation (6) which applies when L=l and t→0.

Hence, the equilibrium value of the neutralization fraction is $$f = \frac{\sigma N_A L \beta c \bar{t}}{l} \tag{14}$$

Methods of reducing f to an acceptable value now can be evaluated by calculating the value of $\bar{t}$.

Having discussed the physics of neutralization of an electron beam from a theoretical viewpoint, attention is now directed to FIG. 3 which diagrammatically illustrates the rearwardmost chamber section 34 of electron beam production and control assembly 12 in accordance with a preferred, actual working embodiment of the present invention. Chamber section 34 is shown in FIG. 3 including an outline of rearward section of overall housing 26 which is electrically grounded (maintained at zero potential). The electron gun 42 is shown in part (by means of its cathode and anode) at the rearward end of chamber section 34. The section of overall housing 26 surrounding chamber section 34 includes an innermost surface 52 which is circular in cross-section and which displays a progressively outwardly stepped configuration from the rearward end of the chamber to the entry of chamber section 36. The geometry of beam 44 including its expanding outer envelope is also shown as it passes through chamber section 34.

Referring to FIG. 4, the potential along the beam axis through chamber section 34 is shown including axially spaced potential wells 54 and 56 associated with the steps in housing surface 52. This potential distribution is calculated from equation (11) for T=100 kV, I=0.590 A. The positive ions produced by the electron beam (as a result of its interaction with residual gas within the beam chamber) are characterized by kinetic energies which are very small compared to the magnitudes of the depths of potential wells. Therefore, these positive ions tend to accumulate at the minima of the potential distribution, that is, within the potential wells, and neutralize the beam. This, in turn, causes the beam to collapse (reduce in size) before reaching the intermediate chamber section and also causes the beam to become less stable if the pressure fluctuates. As will be seen below, means are provided for removing the trapped ions from the potential wells and from the overall beam itself so as to reduce and preferably eliminate their neutralizing effect on the beam. Those ions produced near the electron gun 42 fall into the negative potential well 58 formed by a gun ion trap 60 (see FIG. 3), although this does not form part of this invention.

FIG. 5 shows the transverse potential distribution along a diameter at the potential well 54. It is assumed that the electron beam is cylindrical in a cylindrical beam housing. Numerical values are calculated using equations (9), (10) and (11) for R=38 mm, $r_0$=7 mm, T=100 kV and I=0.590 A. The maximum transverse electric field due to the beam, utilizing these numerical values is 92 V/cm. If a transverse electric field of this magnitude or greater is applied across the beam by a negative electrode at one side of the beam housing, any positive ions formed within the field will be drawn to the negative electrode and thereby be removed from the electron beam. This is the principle behind ion clearing electrodes which form part of the overall electron beam production and control assembly illustrated partially in FIG. 3. Two such electrodes generally indicated at 62 and 64 are shown disposed radially outwardly of and in lateral alignment with the two potential wells 54 and 56, respectively.

One of the ion clearing electrodes, specifically electrode 62, is illustrated in FIGS. 6 and 7. One side of this electrode extends through housing 26 for connection to a negative voltage supply, typically −600 volts in the embodiment illustrated and is isolated from the housing by means of an insulation bushing 66. The other side of the electrode is connected directly to the housing and therefore is at ground potential. The electrode is configured to produce a reasonably uniform electric field normal to the axis of the electrion beam. Electrode 64 is configured in the same way. Also shown in FIG. 5 is the potential distribution due to the beam when the electrode 62 is present but grounded on both sides and the potential distribution with −461 V applied to one side. This is the minimum voltage for extracting ions from the beam. As stated previously, these two electrodes are laterally aligned with potential wells 54 and 56, respectively, in order to remove positive ions therein in accordance with the present invention. Also note that the electrodes are preferably designed to be shielded from the beam by the steps in the beam pipe. This prevents any damage to the electrodes by the beam.

It was found experimentally that the ion clearing electrodes remove positive ions and stabilize the beam against pressure fluctuations (variation in residual gas and therefore positive ion production). It was also verified that electrodes placed at other positions along the beam (longitudinally spaced from the potential wells) had much less effect on beam neutralization. The theory of the operation of ion cleaning electrodes which produce a transverse electric field at the beam may now be completed. This theory has been compared directly to experimental measurements as described below.

If the potential on one side of the electrode is V (the other is grounded) and the radius of the electrode is R, then the field due to the electrode is $E_V \simeq V/2R$. Assuming the ions in the beam are initially at rest, it can then be shown that the average time required to extract an ion from the beam is:

$$\bar{t} \simeq \frac{4}{3c}\left(\frac{Mr_0}{E_v - E_0}\right)^{\frac{1}{2}} \tag{15}$$

where $E_0$ is defined by equation (9).

The approximations involved in this calculation are that the electric field due to the electrodes is uniform and much greater than that due to the beam ($E_v >> E_0$), the neutralization fraction is very small ($f << 1$) and the ions are treated non-relativistically. The beam electrons, on the other hand, are treated fully relativistically [except in the "log" term of equation (5) and in the estimation of $v_0$ (Equation (7)) and $T_I$ (Equation (8))].

Using equations (14) and (15), the equilibrium value of the neutralization fraction is:

$$f \simeq \frac{\sigma N_A L\beta}{l} \cdot \frac{4}{3}\left(\frac{Mr_0}{E_v - E_0}\right)^{\frac{1}{2}} \tag{16}$$

Hence, the minimum voltage which it is necessary to apply to the electrode to maintain a given value of the neutralization fraction f is:

$$V \simeq \frac{64}{9}\left(\frac{\sigma N_A L}{fl}\right)^2 \frac{TMr_0R}{m} \frac{(1 + T/2m)}{(1 + T/m)^2} + V_0 \tag{17}$$

where $$V_0 = 2RE_0 = \frac{2\sqrt{2m}\ R\eta_0 KT}{r_0} \frac{I}{I_{SAT}}(1 + T/2m)(1 + T/m) \tag{18}$$

Note that the first term in equation (17) is proportional to the square of the ionization cross-section and the square of the residual gas pressure whereas the quantity $V_0$ depends only on properties of the electron beam. Although equation (17) was derived in the approximation, $V >> V_0$, it is clearly correct when $N_A = 0$ (residual gas pressure zero) and $V = V_0$. Equation (17) is therefore applicable at all pressures.

In applying equation (17) to a practical situation, the problem arises of assigning values to the geometrical quantities L and l. To take a specific example, let us calculate values of V for the electrode 62 in FIG. 3. An examination of FIG. 4 shows that the beam length L, from which ions flow to the potential well 54, is equal to the distance between the two steps in the beam pipe. The length l, the length of beam from which ions are extracted by the electrode, is more difficult to estimate. It will be assumed that $l = 2R$. Another uncertainty is the value of the beam radius, $r_0$. This was calculated using equation (4) and measurements of the beam radius further downstream. Finally, since it cannot be made identically zero, one has to decide on an acceptable value for the neutralization fraction, f or equivalently the repulsion factor N. The value chosen was $N = 0.9$. One then obtains the neutralization fraction from the equation:

$$f = (1 - N)(1 - \beta^2)$$

(In comparing values of V at different energies, it is better to use a fixed value of N rather than f, since N determines the geometry of the beam.)

Using the above values of the parameters, calculations were made of equation (17) for the voltage on electrode 62, as a function of residual gas pressure for $T = 16$ kV, $I = 34$ mA ($I/I_{SAT} = 1.0$, $k = 1.62 \times 10^{-8}$ $AV^{-3/2}$). Other parameters are $L = 40$ cm, $l = 5$ cm, $r_0 = 0.7$ cm, $R = 2.5$ cm. This calculation is plotted in FIG. 8.

To test the theory, experiments were also performed on the scanning electron beam tube under the same conditions as the calculation. (For the experiments all ion clearing electrodes were connected to the same high voltage supply. This should not affect the results significantly since the presence of ions in the beam at the position of 64 has much less effect on the beam envelope than the presence of ions at the position of 62.) The necessary electrode voltage was determined by observing the beam profile, (obtained by scanning the beam across a tungsten wire connected to an oscilloscope) at the position of the X-ray target 50. The electrode voltage was increased until no discernable improvement in the quality of the beam profile was observed. The experiment was repeated at several typical residual gas pressures in the range $3 \times 10^{-7}$ to $4 \times 10^{-6}$ Torr. Results are plotted in FIG. 8.

One may conclude from these results that the minimum electrode voltage calculated from equation (17) is in general low by a factor between 1 and 2 when the parameter value N=0.9 is used. A better value would be N=0.92. However, the spread in the experimental results, which is due to a subjective judgment of beam quality, does not justify any more precise conclusions.

Suffice it to say that the experiment shows the theory to be substantially correct and that preliminary values for the electrode voltage in other cases may be obtained from it. Final values of the voltage should always be found experimentally for any new embodiment.

As further examples, equation (17) is plotted in FIG. 9 as a function of residual gas pressure for electron beams with kinetic energies 20 kV and 100 kV and $I/I_{SAT}-1$, in the preferred embodiment.

It was found that the deflection of the electron beam by the transverse electric field is extremely small and can be compensated for if necessary by magnetic steering coils (not shown). Assuming that the effective length of the field due to an ion clearing electrode is equal to its radius, deflection of the electron beam is:

$$\theta \simeq V/4T$$

where V is the magnitude of the voltage applied to one electrode. For electrode 62, the deflection for V=600 V, T=100 kV is $\theta=1.5$ mr=0.09°.

If the electrode collects ions from a length L of the beam, the ion current is $I\,\sigma N_A L$. For 0.590 A of 100 kV electrons at $10^{-7}$ Torr and L=160 cm, this is equal to only 2 μamp. Thus power requirements on the electrode power supply are minimal.

With regard to the specific calculations thus far provided (including actual numerical values) as well as those to be provided hereinafter, it is to be understood they are being set forth for exemplary purposes only and are not intended to limit the present invention.

For example, the actual values for ion clearing electrodes 62 and 64 may differ from those shown, depending upon the voltage characteristic of the electron beam itself. This is also true for the number of electrodes utilized and their positional relationship relative to one another. It suffices to say that those with ordinary skill in the art based on the present teachings can readily determine the number of ion clearing electrodes that are necessary, their positions and their voltage characteristics necessary to remove ions from potential wells in a given electron beam depending on the positions and magnitude of the potential wells.

Another approach in accordance with the present invention is to eliminate the potential wells in a way which causes the positive ions as they form to flow through chamber section 34 along with electron beam 44 in an accelerated fashion as in a dowwnardly inclined trough. The acceleration of these ions not only removes them from the region of the beam waist but also reduces their linear charge density which is inversely proportional to their velocity. Also, the ion density only becomes significant where the beam is large but where they may have little influence, that is, near the forward end of chamber section 34. In this regard, it is important that the ions be accelerated away from the beam waist at the rearward end of the chamber section where neutralization is most critical.

The effectiveness of ion clearing methods which depend on accelerating the ions along the beam axis may be estimated as follows. If the axial electric field is E, the average time $\bar{t}$ to remove an ion from a length l of beam is:

$$\bar{t} = \frac{2}{3c}\left(\frac{2Ml}{E}\right)^{\frac{1}{2}} \tag{19}$$

Substituting equation (19) into equation (14) and putting l=L, one obtains:

$$f = \frac{2}{3}\,\sigma N_A \beta \left(\frac{2Ml}{E}\right)^{\frac{1}{2}} \tag{20}$$

Substituting values for an electron beam with T=100 kV into equation (20) and assuming that the critical length of the electron beam waist is not more than 50 cm and that the field E=0.1 V/cm, one obtains $f \leqq 0.04$. This value for the equilibrium neutralization fraction is negligible and would be typical for the ion clearing methods described below.

Referring specifically to FIG. 10, electron beam 44 is shown within chamber section 34 as defined by inner housing surface 52 in the same manner as FIG. 3. However, rather than including ion clearing electrodes, this embodiment utilizes a plurality of graded potential electrodes 70A, 70B etc. through 70H. These electrodes are designed to eliminate the previously described potential wells and specifically so that the potential along the axis of the electron beam decreases monotonically as shown in FIG. 11. In this way, as positive ions form within chamber section 34, they are caused to flow with the electrons forming the beam as stated above. In the particular embodiment illustrated, the voltages on the electrodes successively decrease starting with the first one (electrode 70A) which is maintained at zero volts (ground) and ending with the last one (70H) which is maintained at −175 volts. As shown in FIG. 11, the resulting axial potential gradient or electric field is 0.9 V/cm, sufficient to reduce the neutralization fraction to a negligible value. As seen in FIGS. 12 and 13, the electrode 70B is in the shape of a frustum having its smaller end up-stream from its larger end with respect to the flow of beam 44 and has coupling means 71 extending through housing 26 for connection with its source of voltage. A suitable electrically insulated bushing 72 serves to insulate the electrode and coupling means from the housing. The other electrodes specifically illustrated are configured in the same manner.

Another way of eliminating potential wells in the electron beam and to cause the positive ions to flow with the electrons through chamber section 34 is illustrated in FIGS. 14 and 15. As seen specifically in FIG. 14, the previously described stepped surface 52 is eliminated and replaced with an entirely different profile. New surface 52' is designed to expand continuously at a greater rate than the beam envelope, that is, the ratio $R/r_0$ forming part of the equation (11) set forth previously is made to increase continuously along the beam. Assuming the housing is grounded (which is the case) this causes the potential along the electron beam axis to decrease continuously along the length of the chamber section as seen in FIG. 15 which, in turn, causes the ions to flow along with the electron beam as if graded potential electrodes were used. However, this particular method requires no external power supply and separate electrodes but has the disadvantage that the beam-housing surface clearance near the electron gun is inevitably very small. As shown in FIG. 15, the resulting axial potential gradient or electric field is 0.13 V/cm, sufficient to reduce the neutralization fraction to a negligible value.

In the various embodiments of electron beam production and control assembly 12 thus far described, the ions produced in chamber section 34 were either removed from the electron beam using ion clearing electrodes (see FIG. 3) or they were caused to flow with the electrons, either by means of graded potential electrodes (see FIG. 10) or by the proper configuration of the inner housing surface surrounding chamber section 34 (see FIG. 14). In either of these latter two cases, it is desirable to prevent the ions flowing with the electron beam from following the latter into chamber section 38 and towards target 50. While this can be accomplished by providing specifically designed collecting electrodes, it is preferable to use an already existing component, specifically the deflecting coil 48 illustrated in FIG. 16 and FIG. 2. This coil, as stated previously, serves to bend electron beam 44 into chamber section 38 by producing the appropriately configured magnetic field. As seen in FIG. 16, this magnetic field (+B) deflects the negative electrons ($e^-$) in one direction, specifically into chamber section 38, while causing the positive ions $N_2^+$ to be deflected in a different direction. These deflected ions can be allowed to impinge on the inner surface of housing 26 or a suitable ion collecting electrode (not shown) can be provided.

If it becomes desirable to remove the ions magnetically from electron beam 44 without bending the beam, a plurality of plus and minus deflecting coils can be arranged to provide the +B and −B magnetic fields illustrated in FIG. 17. As seen there, as the electron beam 44 enters this arrangement of fields, its electrons are first diverted from their original path and then eventually returned to that path. However, the ions are diverted from the same path and caused to collect onto an appropriately positioned ion collecting electrode generally indicated at 82.

What is claimed:

1. In a computed tomography X-ray scanning system, an electron beam production and control assembly for producing X-rays, said assembly comprising:

(a) a housing defining an elongated, vacuum sealed chamber having opposite forward and rearward ends;

(b) means for evacuating said chamber of any gases therein;

(c) means for producing an electron beam within said chamber and for directing said beam along a path therethrough from its rearward end to its forward end so as to impinge on a suitable target which is located at the forward end for providing X-rays and which forms part of the scanning system, the electrons forming said beam interacting with any residual gas for producing positive ions, said electron beam forming at least one negative potential well at a fixed point along its path, said potential well trapping said ions therein and preventing the latter from escaping from said beam whereby to have the effect of neutralizing the space charge of the electron beam; and (d) means for acting on said trapped ions, if present, in a way which reduces the neutralizing effect they would otherwise have on said beam, said means acting on said trapped ions including means for removing said trapped ions from said potential well or wells and from the beam all together in order to prevent those ions from neutralizing said beam.

2. An assembly according to claim 1 wherein said ion removing means includes negative electrode means within said chamber for producing an electric field through each of said potential wells and transverse to the path of said beam at the well, each field being sufficiently strong to attract the otherwise trapped ions to said electrode means.

3. An assembly according to claim 2 wherein said beam forms a plurality of said potential wells and wherein said negative electrode means includes an equal plurality of negative electrode arrangements, each of which is laterally spaced from said beam in a plane normal to the path of the latter at and through an associated one of said potential wells.

4. In a computed tomography X-ray scanning system, an electron beam production and control assembly for producing X-rays, said assembly comprising:

(a) a housing defining an elongated, vacuum-sealed chamber having opposite forward and rearward ends;

(b) means for evacuating said chamber of any gases therein;

(c) means for producing an electron beam within said chamber and for directing said beam along a path therethrough from its rearward end to its forward end so as to impinge on a suitable target which is located at the forward end for providing X-rays and which forms part of the scanning system, the electrons forming said beam interacting with any residual gas for producing positive ions which have the effect of neutralizing the space charge of the electron beam; and (d) means for insuring that said ions, if present, flow along with the electrons forming said beam at least to a predetermined point along the beam's path, said insuring means including means for causing the potential along the length and at the center of said beam to continually decrease along a section of said beam from the rearward end of said chamber to a predetermined point in order to substantially eliminate the presence of any potential wells and cause said ions to flow with the electrons forming said beam.

5. An assembly according to claim 4 wherein said beam potential decreasing means includes a plurality of negative voltage electrodes located along the length of said section of said beam path in spaced apart relationship to one another.

6. An assembly according to claim 5 wherein the inner surface of said housing along said beam path section displays a progressively outwardly stepped configuration from the rearward end of said chamber to said point and wherein said negative electrodes successively decrease in voltage starting from said rearward end.

7. An assembly according to claim 6 wherein each of said negative electrodes is configured as a frustum which is disposed concentrically around and spaced outwardly of an adjacent section of said beam with its smaller end closer to the rearward end of said chamber than its larger end.

8. An assembly according to claim 4 wherein said beam potential decreasing means includes the inner surface of said housing along said beam path section, said surface being configured relative to the shape of said beam to cause said potential to continuously decrease along said beam path section in order to eliminate potential wells and cause ions to flow with the electrons forming said beam.

9. An assembly according to claim 8 wherein said electron beam expands gradually from said rearward end to said predetermined point and wherein said housing surface is configured to expand with but at a faster rate than said beam.

10. An assembly according to claim 4 including means for deflecting said ions out of the path of said electron beam at said predetermined point.

11. An assembly according to claim 10 wherein said beam producing and directing means includes magnetic deflecting coil means located at said predetermined point for deflecting said electron beam at said point, said deflecting coil means also serving as said deflecting means.

12. In a computed tomography X-ray scanning system, an electron beam production and control assembly for producing X-rays, said assembly comprising:

(a) a housing defining an elongated, vacuum-sealed chamber having opposite forward and rearward ends;

(b) means for evacuating said chamber of any gases therein;

(c) means including an electron gun for producing an electron beam within said chamber from the latter's rearward end to its forward end in a way which causes the beam to form at least one negative potential well at a fixed point along said path between said ends, the electrons forming said beam interacting with any residual gas within said chamber for producing positive ions many of which become trapped within said potential well or wells; and (d) means for removing said trapped ions from said potential well or wells and from the beam all together.

13. An assembly according to claim 12 wherein said ion removing means includes negative electrode means within said chamber for producing an electric field through each of said potential wells and transverse to the path of said beam at that well, each field being sufficiently strong to attract the otherwise trapped ions to said electrode means, thereby removing them from the well.

14. An assembly according to claim 13 wherein said beam forms a plurality of said potential wells and wherein said negative electrode means includes an equal plurality of negative electrode arrangements, each of which is laterally spaced from said beam in a plane normal to the path of the latter at and through an associated one of said potential wells.

15. In a computed tomography X-ray scanning system, an electron beam production and control assembly for producing X-rays, said assembly comprising:

(a) a housing defining an elongated, vacuum-sealed chamber having opposite forward and rearward ends;

(b) means for evacuating said chamber of any gases therein;

(c) means for producing an electron beam within said chamber and for directing it along a path through the chamber from the rearward end of the latter to its forward end in a way which causes the beam to expand gradually from its waist at said rearward end to a more forward point along the path, the electrons forming said beam interacting with any residual gas producing positive ions which may including some within said beam waist; and (d) means acting on any ions within said beam waist in a way which causes the acted upon ions to flow in the direction of flow of the electron beam out of the waist of the beam and into its expanding section.

16. In a computed tomography X-ray scanning system, an electron beam production and control assembly for producing X-rays, said assembly comprising:

(a) a housing defining an elongated, vacuum-sealed chamber having opposite forward and rearward ends;

(b) means for evacuating said chamber of any gases therein;

(c) means for producing an electron beam within said chamber and for directing it along a path through the chamber from the latter's rearward end to its forward end, the electrons forming said beam interacting with any residual gas producing positive ions within the chamber; and (d) means for causing the potential at the center of said beam along a section of its path to continuously decrease from the rearward end of said chamber to a predetermined point along its length in order to eliminate the presence of any potential wells therebetween which potential wells would otherwise trap at least some of said ions and to cause said ions to flow with the electrons forming said beam.

17. An assembly according to claim 16 wherein said beam potential decreasing means includes a plurality of negative voltage electrodes located along the length of said section of said beam path in spaced-apart relationship to one another.

18. An assembly according to claim 17 wherein the inner surface of said housing along said beam path section displays a progressively outwardly stepped configuration from the rearward end of said chamber to said point and wherein said negative voltage electrodes successively increase in negative voltage starting from said rearward end.

19. An assembly according to claim 18 wherein each of said negative voltage electrodes is configured as a frustum which is disposed concentrically around and spaced outwardly of an adjacent section of said beam with its smaller end closer to the rearward end of said chamber than its larger end.

20. An assembly according to claim 16 wherein said beam potential decreasing means includes the inner surface of said housing along said beam path section, said housing being electrically grounded and said surface being configured relative to the shape of said beam to cause said beam potential to continuously decrease along said beam path section in order to eliminate potential wells and cause ions to flow with the electrons forming said beam.

21. An assembly according to claim 20 wherein said electron beam expands gradually from said rearward to said predetermined point and wherein said housing surface is configured to expand with but at a faster rate than said beam.

22. In a computed tomography X-ray scanning system, an electron beam production and control assembly for producing X-rays, said assembly comprising:

(a) a housing defining an elongated, vacuum-sealed chamber having opposite forward and rearward ends;

(b) means for evacuating said chamber of any gases therein;

(c) means for producing an electron beam within said chamber and for directing said beam along a path therethrough from its rearward end to its forward end so as to impinge on a suitable target located at said forward end for producing X-rays, said producing and directing means including magnetic means for bending said beam at a specific point on its path, the electrons forming said beam interacting with any residual gas producing ions within said chamber;

(d) means for causing any ions located within said chamber between said rearward end and said specific point to flow in the direction of and with the electrons forming said beam to said point; and (e) means for deflecting said ions out of the path of said electron beam at said point, said magnetic means serving as said deflecting means.

23. In a computed tomography X-ray scanning system having a target which produces X-rays as a result of electrons impinging thereon, an electron beam production and control assembly for producing said X-rays, said assembly comprising:

(a) an overall housing defining a vacuum-sealed chamber having a rearward substantially straight chamber section, a forward chamber section extending in a direction transverse to said rearward section and containing said target at its forwardmost end, and an intermediate chamber section between and interconnecting said rearward and forward sections, said rearward section including an inner surface which displays a progressively outwardly stepped configuration starting from the rearward end of that chamber section;

(b) means for evacuating said chamber of any gases therein;

(c) means including an electron gun located at the rearwardmost end of said rearward chamber section for producing an electron beam within the latter and for directing it co-axially along said rearward chamber section toward said intermediate chamber section in a way which causes the beam to interact with said housing to form a negative potential well at a point adjacent to each of the steps of said stepped surface while, at the same time, the electrons forming said beam interact with residual gas in said rearward chamber section producing positive ions, many of which become trapped within said potential wells;

(d) means for removing said trapped ions from one of said potential wells, said means producing an electric field which is strong enough to attract and thereby remove the ions trapped in the latter; and (e) means located within said intermediate chamber section for bending the electron beam into said forward chamber section as the beam comes from said rearward section.

24. An assembly according to claim 23 wherein said ion removing means includes an electrode means laterally adjacent each of said wells behind an adjacent step of said stepped surface such that said steps shield all of said electrode means from said beam.

25. A method of producing and controlling an electron beam in producing X-rays in a computed tomography X-ray scanning system, said method comprising:

(a) providing a housing defining an elongated, vacuum-sealed chamber having opposite forward and rearward ends;

(b) evacuating said chamber of any gases therein except for small amounts of residual gas;

(c) producing an electron beam within said chamber and directing it along a path through the chamber from the latter's rearward end to its forward end in a way which causes the beam to form at least one negative potential well at a fixed point along said path, the electrons forming said beam interacting with said residual gas producing positive ions many of which become trapped within said potential well or wells; and (d) removing said trapped ions from said potential well or wells and from the beam all together.

26. A method according to claim 25 wherein said trapped electrons are removed by producing an electric field through each of said potential wells and transverse to the path of said beam at the well by means of a negative electrode, each field being sufficiently strong to attract the otherwise trapped ions to said electrode, thereby removing them from the well.

27. A method of producing and controlling an electron beam in producing X-rays in a computed tomography X-ray scanning system, said method comprising:

(a) providing a housing defining an elongated, vacuum-sealed chamber having opposite forward and rearward ends;

(b) evacuating said chamber of any gases therein except for small amounts of residual gas;

(c) producing an electron beam within said chamber and directing it along a path through the chamber from the rearward end of the latter to its forward end in a way which causes the beam to expand gradually from its waist at said rearward end to a more forward point along the path, the electrons forming said beam interacting with said residual gas producing positive ions which may include same within said beam waist; and (d) causing any ions within said beam waist to flow from said waist in the direction of said target and into the expanding section of said beam.

28. A method according to claim 27 wherein said ions are caused to flow in the direction of said beam by causing the potential along the length and at the center of said beam to continually decrease along a section of said beam from the rearward end of said chamber to said forward point in order to substantially eliminate the presence of any potential wells therebetween, which potential wells would otherwise trap at least some of said ions and to cause said ions to flow with the electrons forming said beam.

29. A method of producing and controlling an electron beam in producing X-rays in a computed tomography X-ray scanning system, said method comprising:

(a) providing a housing defining an elongated, vacuum-sealed chamber having opposite forward and rearward ends;

(b) evacuating said chamber of any gases therein except for small amount of residual gas;

(c) producing an electron beam within said chamber and directing it along a path through the chamber from the latter's rearward end to its forward end, the electrons forming said beam interacting with said residual gas producing positive ions within the chamber; and (d) causing the potential along the length and on the axis of said beam to continuously decrease from the rearward end of said chamber to a predetermined point along its length in order to eliminate the presence of any potential wells therebetween which potential wells would otherwise trap at least some of said ions and to cause said ions to flow with the electrons forming said beam.

30. A method of producing and controlling an electron beam in producing X-rays in a computed tomography X-ray scanning system, said method comprising:

(a) providing a housing defining an elongated, vacuum-sealed chamber having opposite forward and rearward ends;

(b) evacuating said chamber of any gases therein except for small amount of residual gas;

(c) producing an electron beam within said chamber and directing said beam along a path therethrough from its rearward end to its forward end whereby to impinge on a suitable target located at said forward end for producing X-rays, said beam being bent by magnetic means at a specific point on said path, the electrons forming said beam interacting with said residual gas for producing ions within said chamber;

(d) eliminating any potential well along the path of said electron beam between said rearward end and said specific point in order to cause any ions located within said chamber between said rearward end and said specific point to flow with the electrons forming said beam to said point; and (e) deflecting said ions out of the path of said electron beam at said point using said magnetic means to do so.

* * * * *

UNITED STATES PATENT AND TRADEMARK OFFICE

CERTIFICATE OF CORRECTION

PATENT NO. : 4,521,900

DATED : June 4, 1985

INVENTOR(S) : Roy E. Rand

It is certified that error appears in the above—identified patent and that said Letters Patent is hereby corrected as shown below:

Column 1, line 30: Delete "the" and insert --and--.

Column 5, line 34: The Equation should read:

$$S = \sqrt{2m}\eta_o K$$

Column 5, line 46: delete "of".

Column 6, line 2: delete "N-O" and insert --N<O--.

Column 6, line 31: delete "μ" and insert --ρ--.

Column 6, line 42: delete "-" at the end of the sentence.

Column 6, line 55: The Equation should read: $2\sqrt{2m}T$.

Column 7, line 11: Delete "and $r_o$"

Column 7, line 39: Delete "therefor" and insert --therefore--.

UNITED STATES PATENT AND TRADEMARK OFFICE

CERTIFICATE OF CORRECTION

PATENT NO. : 4,521,900

DATED : June 4, 1985

INVENTOR(S) : Roy E. Rand

It is certified that error appears in the above—identified patent and that said Letters Patent is hereby corrected as shown below:

Column 11, line 16: The Equation should read:

$$I/I_{sat}=1$$

Column 11, line 55: Delete "dowwnardly" and insert --downwardly--.

Signed and Sealed this

*Eleventh* Day of *March 1986*

[SEAL]

*Attest:*

DONALD J. QUIGG

*Attesting Officer*

*Commissioner of Patents and Trademarks*